United States Patent [19]

Resch, III et al.

[11] Patent Number: 4,875,078

[45] Date of Patent: Oct. 17, 1989

[54] DEAD TIME COMPENSATION FOR TONER REPLENISHMENT

[75] Inventors: William A. Resch, III, Pittsford; Jonathan E. Moak, Macedon, both of N.Y.

[73] Assignee: Eastman Kodak Company, Rochester, N.Y.

[21] Appl. No.: 241,993

[22] Filed: Sep. 8, 1988

[51] Int. Cl.[4] ..... G03G 15/08

[52] U.S. Cl. ..... 355/246; 355/245; 355/204; 355/208

[58] Field of Search ..... 355/246, 245, 204, 208

[56] References Cited

U.S. PATENT DOCUMENTS

| | | | |
|---|---|---|---|
| 4,416,535 | 11/1983 | Tottori | 355/246 |
| 4,536,080 | 8/1985 | Hauser et al. | 355/246 |
| 4,571,068 | 2/1986 | Tarumi et al. | 355/246 |
| 4,647,185 | 3/1987 | Takeda et al. | 355/246 |
| 4,660,505 | 4/1987 | Goto et al. | 355/246 |
| 4,671,646 | 6/1987 | Florack et al. | 355/246 |
| 4,708,458 | 11/1987 | Ueda et al. | 355/246 |
| 4,734,737 | 3/1988 | Koichi | 355/246 X |
| 4,786,942 | 11/1988 | Kusumoto et al. | 355/246 X |

*Primary Examiner*—A. C. Prescott

*Attorney, Agent, or Firm*—Milton S. Sales

[57] ABSTRACT

A toner replenishment control apparatus does not require waiting between replenishment cycles for a period sufficient to insure that the toner in the station is well mixed and charged, and yet does not require artificially limiting the amount of toner added to avoid over-concentration. Information is stored concerning the rates of toner addition in response to a detected concentration error, and the stored information is used in conjunction with future measurements of conconetration error to determine the correct amount of toner needed. More specifically, the replenishment rate is based on (1) the present toner concentration error, (2) an initial replenishment rate which occurred sufficiently prior to insure that the added toner is well mixed and charged, and (3) the toner concentration error which dictated that initial replenishment rate.

15 Claims, 4 Drawing Sheets

DEAD TIME COMPENSATION FOR TONER REPLENISHMENT

BACKGROUND OF THE INVENTION

1. Field of the Invention

This invention relates to the field of electrostatography and, more particularly, to improvements in apparatus for controlling toner replenishment.

2. Description of Prior Art

In electrostatography, electrostatic images formed on a dielectric recording element are rendered visible via the application of pigmented, thermoplastic particles known as toner. Typically, such toner forms part of a two-component developer mix consisting of the toner particles and magnetically-attractable carrier particles to which the toner particles adhere via triboelectric forces. During the development process, the electrostatic forces associated with the latent image act to strip the toner particles from their associated carrier particles, and the partially denuded carrier particles are returned to a reservoir.

Several techniques are known for replenishing the spent development mix with fresh toner. They include monitoring the toner concentration in the developer mix, monitoring the amount of toner applied to the recording member during development, and monitoring the number of character print signals applied to a print head.

Whatever the replenishment method, when toner is added to the developer mix, the added toner participates in the development process only after some delay determined by the flow and mixing patterns of the toning station, the tribo-charging characteristics of the toner, and any time periods during which the station is idle. Such a delayed response can be experienced in the time between addition of toner and its being sensed by a concentration monitor. A delayed response can also be experienced in the time between addition of toner and some response in the toned image. In addition, the effects of removal of toner by the imaging process manifest themselves after a similar delay. During the duration of such a delay, any estimate of the amount of toner in the toning station will be in error, since the change in the amount of toner in the station is, in effect, not detectable to the sensing means.

There are two traditional methods known in the prior art for handling this problem. First, the controlling mechanism can be forced to wait between replenishment cycles for a period (referred to herein as "dead time") sufficient to insure that the toner in the station is well mixed and charged and is detectable by the sensing means. If this waiting period is much longer than the image frame period, many frames are toned before fresh toner can be added. Indeed, the waiting period may be measured in image frames. This permits substantial amounts of toner take-out and large individual additions of fresh toner. The result is an undesirable amount of toner concentration variation.

A second method known in the prior art for controlling replenishment measures the toner concentration more frequently and does not wait for the toner in the station to be well mixed and charged; but the method artificially limits the amount of toner added in order to minimize periodic over-concentrations. This detuning technique, in effect, results in the use of a lower-than-optimum control system gain and slows the response of the control system.

SUMMARY OF THE INVENTION

In view of the foregoing discussion, an object of this invention is to provide a toner replenishment control apparatus which overcomes the aforementioned disadvantages of prior art systems.

Another object of the present invention is to provide a toner replenishment control apparatus which does not require waiting between replenishment cycles for a period sufficient to insure that the toner in the station is well mixed and charged, and yet does not require artificially limiting the amount of toner added to avoid over-concentration.

Yet another object of the present invention is to provide a toner replenishment control apparatus which effects replenishment cycles for substantially each image frame and yet does not require artificially limiting the amount of toner added to avoid over-concentration.

More specifically, an object of the present invention is to store information concerning the rates of toner addition in response to a detected concentration error, and to use the stored information in conjunction with future measurements of concentration error to determine the correct amount of toner needed.

According to these and other objects, the present invention provides a system of frequent replenishment cycles, while inhibiting instabilities by basing the replenishment rate on (1) the present toner concentration error, (2) an initial replenishment rate which occurred sufficiently prior to insure that the added toner is well mixed and charged, and (3) the toner concentration error which dictated that initial replenishment rate.

According to a preferred embodiment of the present invention, an electrostatographic machine replenishment process produces an error signal having a value indicative of the difference between a process variable sensitive to the ratio of toner to carrier in the mix and a setpoint for that variable. A replenishment rate is determined based on the error signal, a prior replenishment rate, and the error signal at the time the prior rate was determined. The prior replenishment rate and associated error signal were stored just before the start of the dead time period.

The invention and its various advantages will become more apparent to those skilled in the art from the ensuing detailed description of preferred embodiments, reference being made to the accompanying drawings.

BRIEF DESCRIPTION OF THE DRAWINGS

The subsequent description of the preferred embodiments of the present invention refers to the attached drawings, wherein.

DESCRIPTION OF THE PREFERRED EMBODIMENT

Figure 1:
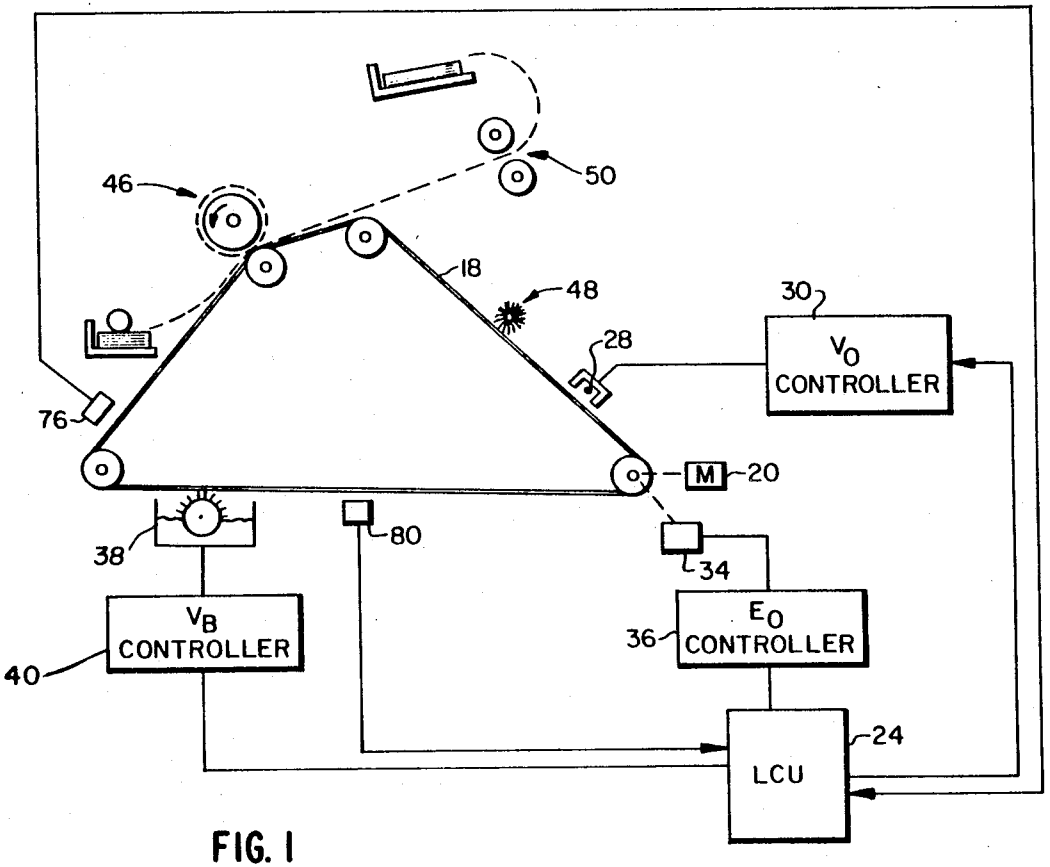
FIG. 1 is a schematic showing a side elevational view of an electrostatographic machine in accordance with a preferred embodiment of the invention.

To facilitate understanding of the foregoing, the following terms are defined:

$V_B$=Development station electrode bias.

$V_0$=Primary voltage (relative to ground) on the photoconductor just after the charger. This is sometimes referred to as the "initial" voltage.

$V_F$=Photoconductor voltage (relative to ground) just after exposure.

$E_0$=Exposure light.

E=Actual exposure of photoconductor. Light $E_0$ illuminates the photoconductor and causes a particular level of exposure E of the photoconductor.

Contrast and density control is achieved by the choice of the levels of $V_0$, $E_0$, and $V_B$. For a detailed explanation of the theory of printer contrast and exposure control by controlling initial voltage, exposure, and bias voltage, reference may be made to the following article: Electrophotographic Systems Solid Area Response Model, 22 Photographic Science and Engineering 150, Paxton (May/June 1978).

Another term used herein is "toning contrast", by which is meant the ratio of the output maximum density $D_{max}$ to the absolute value of the difference between $V_B$ and $V_F$, or $V_B$ and $V_0$, corresponding to a region of maximum density.

A moving recording member such as photoconductive belt 18 is driven by a motor 20 past a series of work stations of the printer. A logic and control unit (LCU) 24, which has a digital computer, has a stored program for sequentially actuating the work stations.

For a complete description of the work stations, see commonly assigned U.S. Pat. No. 3,914,046. Briefly, a charging station 28 sensitizes belt 18 by applying a uniform electrostatic charge of predetermined primary voltage $V_0$ to the surface of the belt. The output of the charger is regulated by a programmable controller 30, which is in turn controlled by LCU 24 to adjust primary voltage $V_0$.

At an exposure station 34, projected light from a write head dissipates the electrostatic charge on the photoconductive belt to form a latent image of a document to be copied or printed. The write head preferably has an array of light-emitting diodes (LED's) or other light source for exposing the photoconductive belt picture element (pixel) by picture element with an intensity regulated by a programmable controller 36 as determined by LCU 24. Of course, one skilled in the art will recognize that the present invention is applicable to optical copiers as well as to the electronic copiers of the preferred embodiment.

Travel of belt 18 brings the areas bearing the latent charge images into a development station 38. The development station is illustrated with only one magnetic brush for clarity. However, it will be understood that a plurality of color toners, including black, may be provided; each having its own magnetic brush in juxtaposition to, but spaced from, the travel path of the belt. Magnetic brush development stations are well known. For example, see U.S. Pat. Nos. 4,473,029 to Fritz et al and 4,546,060 to Miskinis et al.

LCU 24 selectively activates the development station in relation to the passage of the image areas containing latent images to selectively bring the magnetic brush into engagement with the belt. The charged toner particles of the engaged magnetic brush are attracted to the oppositely charged latent imagewise pattern to develop the pattern.

As is well understood in the art, conductive portions of the development station, such as conductive applicator cylinders, act as electrodes. The electrodes are connected to a variable supply of D.C. potential $V_B$ regulated by a programmable controller 40.

A transfer station 46 and a cleaning station 48 are both fully described in commonly assigned U.S. patent application Ser. No. 809,546, filed Dec. 16, 1985. After transfer of the unfixed toner images to a receiver sheet, such sheet is transported to a fuser station 50 where the image is fixed.

Logic and Control Unit (LCU)

Programming commercially available microprocessors is a conventional skill well understood in the art. The following disclosure is written to enable a programmer having ordinary skill in the art to produce an appropriate control program for such a microprocessor. The particular details of any such program would depend on the architecture of the designated microprocessor.

Figure 2:
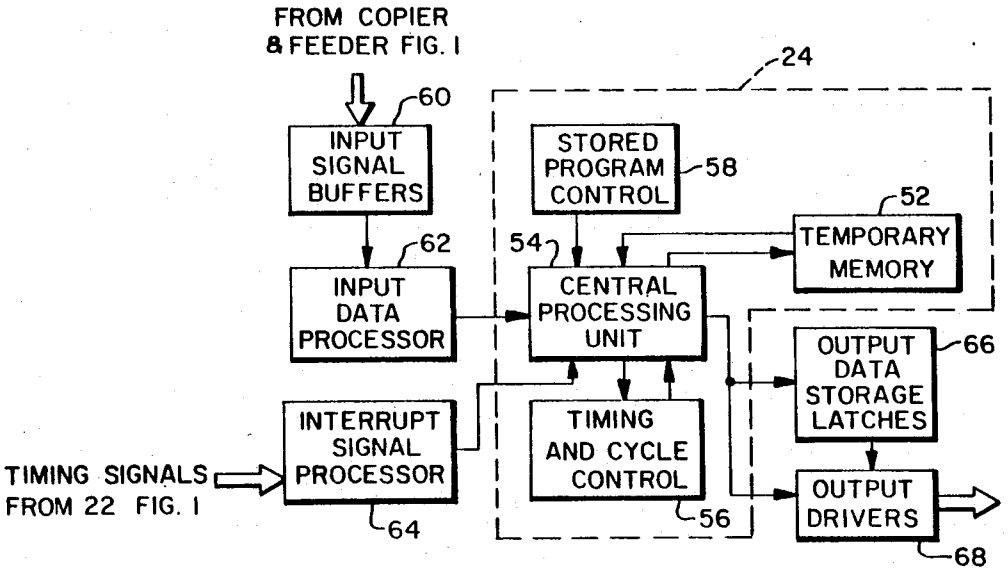
FIG. 2 is a block diagram of the logic and control unit shown in FIG. 1.

Referring to FIG. 2, a block diagram of a typical LCU 24 is shown. The LCU consists of temporary data storage memory 52, central processing unit 54, timing and cycle control unit 56, and stored program control 58. Data input and output is performed sequentially under program control. Input data are applied either through input signal buffers 60 to an input data processor 62 or through an interrupt signal processor 64. The input signals are derived from various switches, sensors, and analog-to-digital converters.

The output data and control signals are applied directly or through storage latches 66 to suitable output drivers 68. The output drivers are connected to appropriate subsystems.

Feedback Process Control

Process control strategies generally utilize various sensors to provide real-time control of the electrostatographic process and to provide "constant" image quality output from the user's perspective.

One such sensor may be a densitometer 76 to monitor development of test patches on photoconductive belt 18, as is well known in the art. The densitometer is intended to insure that the transmittance or reflectance of a toned patch on the belt is maintained. The densitometer may consist of an infrared LED which shines through the belt or is reflected by the belt onto a photodiode. The photodiode generates a voltage proportional to the amount of light received. This voltage is compared to the voltage generated due to transmittance or reflectance of a bare patch, to give a signal representative of an estimate of toned density. This signal may be used to adjust $V_0$, $E_0$, or $V_B$; and, as explained below, to assist in the maintenance of the proper concentration of toner particles in the developer mixture.

Figure 3:
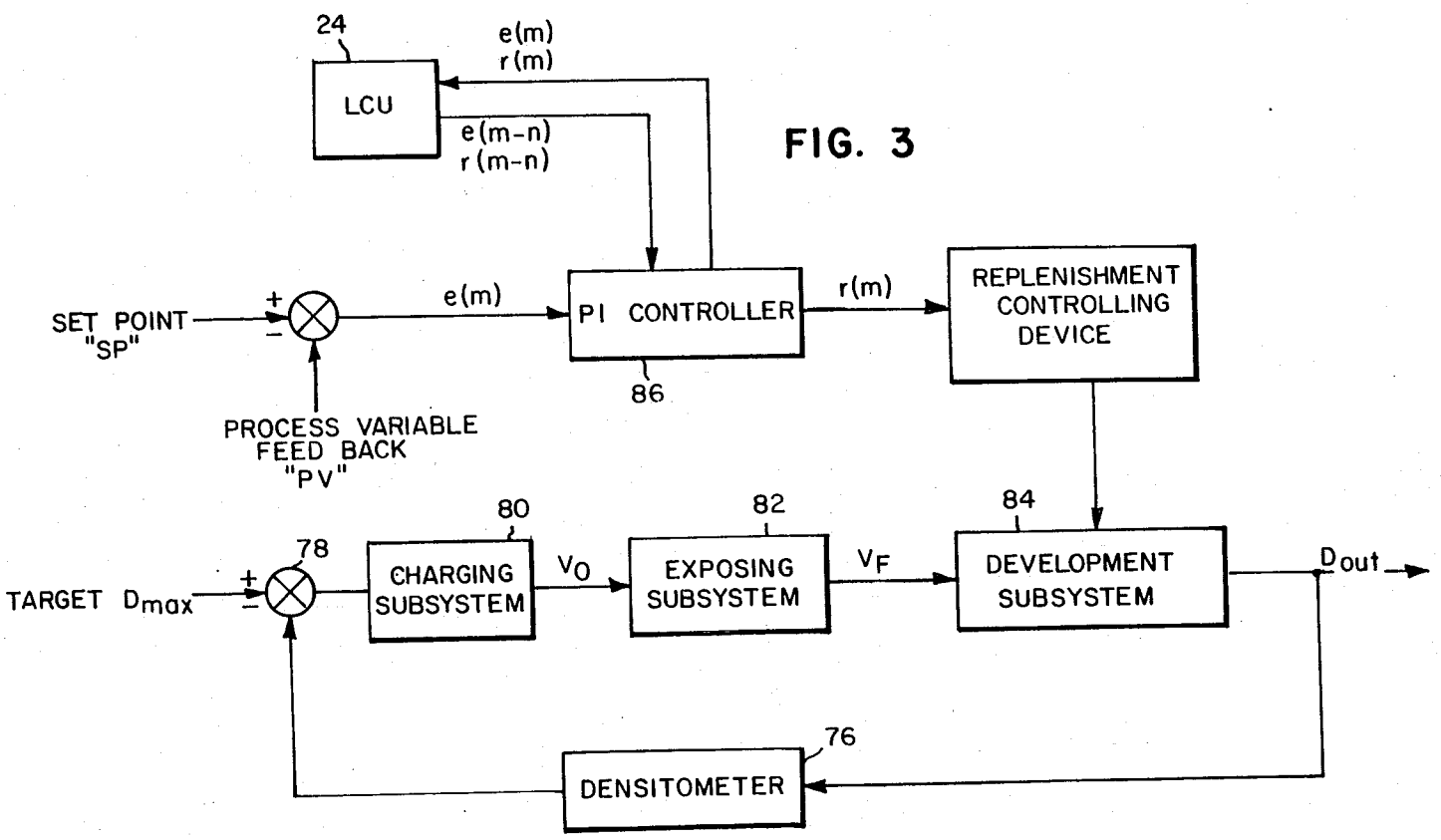
FIG. 3 is a diagram of the process for deriving a development station replenishment control signal for the electrostatographic machine of FIG. 1.

In a preferred embodiment illustrated in FIG. 3, the density signal is used to control primary voltage $V_0$. The output of densitometer 76, upon being suitably amplified, is compared at 78 to a reference signal value "Target $D_{max}$" representing a dsired maximum density output level. The error signal output of comparator 78 is used to adjust a charging subsystem 80, an exposing subsystem 82, and/or a development subsystem 84.

Replenishment

Replenishment is a continuous process that is conventionally controlled by monitoring a process variable sensitive to the ratio of toner to carrier in the development mix. Such process variables include toner concentration, toning contrast, toned density of a test patch, etc. In the preferred embodiment illustrated in FIG. 3, a proportional and integral controller 86 generates an instantaneous output replenishment rate "r(m)" based partially upon an error "e(m)" where the error is the difference between a setpoint value "SP" (the value of the process variable under ideal process conditions) and a feedback signal "PV" (the actual value of the process variable). Thus, the error can be defined as:

$$e(m)=SP-PV \tag{1}$$

While the most basic method of control would be to merely compare SP and PV with the output being either on or off, a more precise control of the replenishment process is required, such as by making a replenishment signal R(m) proportional to the error e(m). That is:

$$R(m)=Ke(m) \tag{2}$$

where K is the proportional gain (also referred to as the proportional sensitivity). Replenishment signal R(m) in equation (2) represents the change in the output replenishment rate from some reference value $R_X(m)$. That is, the replenishment signal is given by;

$$R(m)=r(m)-R_X(m)=Ke(m) \tag{3}$$

Reference value $R_X(m)$ is also known as the bias term, and is the replenishment rate when the error is zero. How $R_X(m)$ is determined will be discussed in detail below.

With proportional control, a finite error results in a finite output. This finite output may not, however, bring the process back to the setpoint. Accordingly, the output must be changed by adjusting reference value $R_X(m)$ to reset the controller output whenever there is an imbalance in the process. For a process that is constantly changing, however, this reset action would require constant monitoring and adjustment. Accordingly, we have provided for slowly changing reference value $R_X(m)$ as long as there is a process error by integrating the error, with the resultant accumulation becoming the bias term $R_X(m)$.

Although a purely integral control would remove the error at stabilization, the process response would be slow. Therefore, we provide both proportional and integral control. The result is the proportional-integral (PI) controller 86. The PI controller is generally described by the following:

$$r(m)=K[e(m)+(1/m_i)\int e(m)dm]+R_X(m) \tag{4}$$

where reset period $m_i$ is the tuning coefficient for the reset mode.

Determining the Initial Reference Value

As can be seen from equation (4), the output replenishment rate is a function of the present error e(m) and the current reference value $R_X(m)$. Generally, the current reference value is that rate used in the immediately prior calculation. However, this would lead to instabilities unless a period, sufficient to insure that the added toner has been well mixed and charged, has been provided since the last replenishment operation before the next error e(m) is determined. For the reasons set forth above, provision of such a long period between replenishment cycles results in an undesirable amount to toner concentration variation.

Accordingly, we have provided a system of frequent replenishment cycles, while inhibiting instabilities by basing the output replenishment rate on (1) the present error e(m), (2) a reference value $R_X(m-n)$ where n is the number of periods sufficient to insure that the toner added is well mixed and charged, and (3) the error signal e(m−n). Accordingly, equation (4) becomes:

$$r(m)=K[e(m)+(1/m_i)\int e(m)dm+e(m-n)]+R_X(m-n) \tag{5}$$

Figure 4:
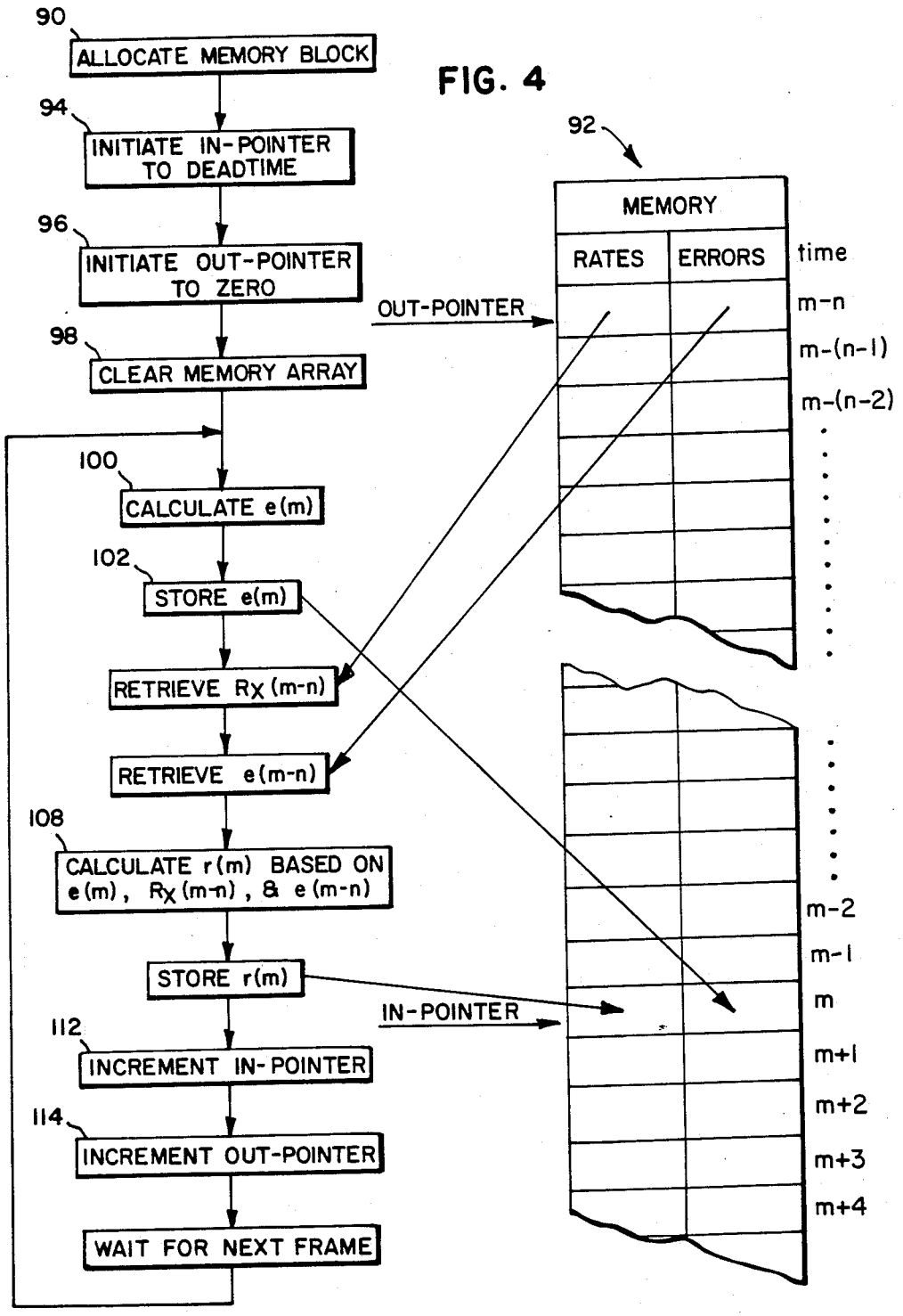
FIG. 4 is a logic flow diagram of the replenishment control process according to a preferred embodiment of the present invention.

FIG. 4 is a logic flow diagram showing the replenishment control process according to a preferred embodiment of the present invention. In a conventional microprocessor, a programmable logic array, or discrete logic could be implemented to perform the functions shown in the flowchart.

The first block 90 is a function block for allocation of a memory block such as illustrated at 92. Memory 92 is at least large enough for the amount of dead time expected. The pointers are actually indices that are incremented in modulo, or "wrap-around," fashion. Initialization of the indices at logic blocks 94 and 96 sets the out-pointer to "m−n" and the in-pointer to "m" where n equals the dead time.

After the memory has been cleared (block 98), an entry is made at "m" starting with a calculation of error e(m) in logic block 100 and storage of e(m) at the in-pointer location; logic block 102. An initial reference value $R_X(m-n)$ and e(m−n) are retrieved from memory at the out-pointer and are used, in accordance with equation (5) to calculate a new instantaneous output replenishment rate "r(m)"; logic block 108.

The newly calculated output replenishment rate r(m) is stored at the in-pointer location, and the in-pointer and out-pointer are incremented at logic blocks 112 and 114, looping back in memory 92 if necessary. The replenishment routine is repeated each image frame.

The invention has been described in detail with particular reference to a preferred embodiment thereof, but it will be understood that variations and modifications can be effected within the spirit and scope of the invention.

What is claimed is:

1. Toner replenishment control apparatus for development stations having means to add, mix, and charge toner particles, said apparatus comprising:

means for monitoring the toner concentration in the developer mix;

means for producing and storing initial toner concentration error and associated replenishment rate reference signals; and means to produce an output replenishment rate based on the present toner concentration error signal and an initial toner concentration error signal and its associated replenishment rate reference signal stored for a period sufficiently long to assure that the toner has been well mixed and charged.

2. Apparatus as defined in claim 1 wherein said rate producing means is a proportional and integral controller.

3. Apparatus as defined in claim 1 wherein said rate producing means produces an output replenishment rate r(m) based on the present toner concentration error signal e(m), an initial toner concentration error signal e(m−n), and the replenishment rate reference signal $R_X(m-n)$ associated with initial toner concentration error signal e(m−n) substantially in accordance with the equation:

$$r(m)=K[e(m)+(1/m_i)\int e(m)dm+e(m-n)]+R_X(m-n),$$

where K is proportional gain and n is the number of periods sufficient to assure that the toner has been well mixed and charged.

4. An electrostatographic machine comprising:

means for contacting an electrostatic image-bearing member with a development mix of toner and carrier particles;

means for replenishing the toner in the mix at a determined rate;

means for from time to time producing error signals having values indicative of the difference between the toner concentration in the mix and a setpoint toner concentration;

means for storing the calculated replenishment rate and the error signal used;

means for from time to time determining replenishment rates based on a present error signal, a replenishment rate which has been stored for a period sufficiently long to assure that the toner has been well mixed and charged, and the stored error signal associated with said stored replenishment rate.

5. Apparatus as defined in claim 4 wherein said rate producing means is a proportional and integral controller.

6. Apparatus as defined in claim 4 wherein said rate producing means produces an output replenishment rate r(m) based on the present toner concentration error signal e(m), an initial toner concentration error signal e(m−n), and the replenishment rate reference signal $R_X(m-n)$ associated with initial toner concentration error signal e(m−n) substantially in accordance with the equation:

$$r(m)=K[e(m)+(1/m_i)\int e(m)dm+e(m-n)]+R_X(m-n),$$

where K is proportional gain and n is the number of periods sufficient to assure that the toner has been well mixed and charged.

7. An electrostatographic machine comprising:

means for contacting an electrostatic image-bearing member with a development mix of toner and carrier particles;

means for replenishing the toner in the mix at a determined rate, said replenishing means having a predetermined mixing and charging dead time;

means for from time to time producing error signals having values indicative of the difference between a process variable sensitive to the ratio of toner to carrier in the mix and a setpoint value for that variable;

means for storing the calculated replenishment rate and the error signal used;

means for from time to time determining replenishment rates based on a present error signal, a replenishment rate which has been stored for substantially the dead time, and the stored error signal associated with said stored replenishment rate.

8. Apparatus as defined in claim 7 wherein said rate producing means is a proportional and integral controller.

9. Apparatus as defined in claim 7 wherein said rate producing means produces an output replenishment rate r(m) based on the present toner concentration error signal e(m), an initial toner concentration error signal e(m−n), and the replenishment rate reference signal $R_X(m-n)$ associated with initial toner concentration error signal e(m−n) substantially in accordance with the equation:

$$r(m)=K[e(m)+(1/m_i)\int e(m)dm+e(m-n)]+R_X(m-n),$$

where K is proportional gain and n is the number of periods sufficient to assure that the toner has been well mixed and charged.

10. Toner replenishment control method for development stations having means to add, mix, and charge toner particles, said method comprising:

monitoring the toner concentration in the developer mix;

producing and storing initial toner concentration error and associated replenishment rate reference signals; and producing an output replenishment rate based on the present toner concentration error signal and an initial toner concentration error signal and its associated replenishment rate reference signal stored for a period sufficiently long to assure that the toner has been well mixed and charged.

11. The method as defined in claim 10 wherein said rate producing step comprises producing an output replenishment rate r(m) based an the present toner concentration error signal e(m), an initial toner concentration error signal e(m−n), and the replenishment rate reference signal $R_X(m-n)$ associated with initial toner concentration error signal e(m−n) substantially in accordance with the equation:

$$r(m)=K[e(m)+(1/m_i)\int e(m)dm+e(m-n)]+R_X(m-n),$$

where K is proportional gain and n is the number of periods sufficient to assure that the toner has been well mixed and charged.

12. A process comprising:

contacting an electrostatic image-bearing member with a development mix of toner and carrier particles;

replenishing the toner in the mix at a determined rate;

from time to time producing error signals having values indicative of the difference between the toner concentration in the mix and a setpoint toner concentration;

storing the calculated replenishment rate and the error signal used;

from time to time determining replenishment rates based on a present error signal, a replenishment rate which has been stored for a period sufficiently long to assure that the toner has been well mixed and charged, and the stored error signal associated with said stored replenishment rate.

13. The process defined in claim 12 wherein said rate producing step produces an output replenishment rate r(m) based on the present toner concentration error signal e(m), an initial toner concentration error signal e(m−n), and the replenishment rate reference signal $R_X(m-n)$ associated with initial toner concentration error signal e(m−n) substantially in accordance with the equation:

$$r(m)=K[e(m)+(1/m_i)\int e(m)dm+e(m-n)]+R_X(m-n),$$

where K is proportional gain and n is the number of periods sufficient to assure that the toner has been well mixed and charged.

14. A process comprising:

contacting an electrostatic image-bearing member with a development mix of toner and carrier particles;

replenishing the toner in the mix at a determined rate and a predetermined mixing and charging dead time;

from time to time producing error signals having values indicative of the difference between a process variable sensitive to the ratio of toner to carrier in the mix and a setpoint value for that variable;

storing the calculated replenishment rate and the error signal used;

from time to time determining replenishment rates based on a present error signal, a replenishment rate which has been stored for substantially the dead time, and the stored error signal associated with said stored replenishment rate.

15. The process as defined in claim 14 wherein said rate producing step produces on output replenishment rate r(m) based on the present toner concentration error signal e(m), an initial toner concentration error signal e(m−n), and the replenishment rate reference signal $R_X(m-n)$ associated with initial toner concentration error signal e(m−n) substantially in accordance with the equation:

$$r(m)=K[e(m)+(1/m_i)\int e(m)dm+e(m-n)]+R_X(m-n),$$

where K is proportional gain and n is the number of periods sufficient to assure that the toner has been well mixed and charged.

* * * * *